United States Patent [19]

Leonard

[11] 3,960,742

[45] June 1, 1976

[54] WATER-DISPERSABLE SOLVENT EMULSION TYPE CLEANER CONCENTRATE

[75] Inventor: Edward O. Leonard, Northlake, Ill.

[73] Assignee: Chemical Cleaning Composition Trust, Chicago, Ill.

[22] Filed: June 29, 1973

[21] Appl. No.: 375,119

[52] U.S. Cl. ..... 252/90; 252/139; 252/153; 252/154; 252/158; 252/159; 252/165; 252/525; 252/527; 252/539; 252/540; 252/544; 252/546; 252/558; 252/559; 252/DIG. 8; 252/DIG. 14

[51] Int. Cl.[2] ..... C11D 17/00

[58] Field of Search ..... 252/527, 525, 139, 544, 252/153, 154, 158, DIG. 8, DIG. 14, 90, 165, 546

[56] References Cited

UNITED STATES PATENTS

| | | | |
|---|---|---|---|
| 3,031,409 | 4/1962 | Perlman et al. | 252/90 X |
| 3,413,229 | 11/1968 | Bianco et al. | 252/90 |
| 3,634,260 | 1/1972 | Pickin | 252/90 X |
| 3,839,234 | 10/1974 | Roscoe | 252/544 |

*Primary Examiner*—Leland A. Sebastian
*Assistant Examiner*—E. Suzanne Parr
*Attorney, Agent, or Firm*—Wolfe, Hubbard, Leydig, Voit & Osann, Ltd.

[57] ABSTRACT

A solvent emulsion type cleaner concentrate provides effective cleaning at recommended water dilutions of 896:1. The concentrate comprises about 30–60 parts by weight of an ethylene glycol monoalkyl ether solvent, together with inorganic alkaline solids and small amounts of two or more solids-suspending surfactants. The concentrate is non-flammable, ecologically acceptable, relatively non-toxic, and has corrosion inhibiting properties.

13 Claims, No Drawings

WATER-DISPERSABLE SOLVENT EMULSION TYPE CLEANER CONCENTRATE

This invention relates to water dispersible solvent emulsion type cleaners, and more particularly provides such a cleaner which, after dilution with up to about 896:1 parts of water—one ounce of concentrate in seven gallons—is an effective aqueous cleaning medium for hard and soft surfaces.

The removal of asphalts, greases, greasy soils, floor wax, metal working oils, tire and heel marks is one of the most common, yet most troublesome, industrial and household maintenance operations. Organic solvent type cleaners, in most instances, are either flammable or highly toxic. Inorganic alkali type cleaners are dangerous to the user, and often are highly corrosive to the underlying floor surface. Ingredients of many cleaners, particularly the phosphates, are unacceptable from a pollution standpoint. Accordingly, a major object of the invention is to provide a cleaning solution, and a concentrate therefor, which is capable of removing the foregoing materials from hard and soft surfaces; which, in either the concentrate or diluted form, is noninflammable, relatively non-toxic, and relatively noncorrosive.

It has heretofore been proposed to employ water-dispersible solvent emulsion type cleaners which include an organic solvent, and one or more alkalies. While these are widely used, they tend to be un-stable upon storage, can be diluted only with comparatively small amounts of water, and contain phosphate materials. Another object is to provide a water-dispersible solvent emulsion type cleaner which is stable for long periods, which has a recommended dilution of one part of concentrate in 896 part water (one ounce in seven gallons); and which is free of phosphates or other ecologically inacceptable ingredients. Still another object is to provide a solvent emulsion type cleaner which is readily prepared at reasonable cost, highly concentrated for low cost shipping, and yet remarkably stable upon storage, easily used, and effective at normal temperatures.

Other and further aims, objects, and advantages of the invention will become apparent as the description thereof proceeds.

Briefly, in accordance with the invention, a water-dispersible solvent emulsion type cleaner concentrate is provided which combines the action of a strong organic solvent, high concentrations of inorganic alkalies, and small amounts of two or more surfactants to maintain the inorganic ingredients in a stable suspension. More particularly, the concentrate comprises about 30–60 parts by weight of an ethylene glycol mono(lower)alkyl ether solvent, about 17–24.5 parts of an alkali hydroxide, about 9–15 parts of an alkali metasilicate, about 1.2–3.45 parts of a nonionic ampholyte which is either a (higher)alkyl betaine or an alkali salt of a N-(higher)alkyl beta aminodipropionate, and about 0.6–1 parts of an anionic hydrotrope selected from the alkali salts of benzene and (lower)alkyl benzene sulfonates. Optionally, and preferably, it also contains about 0.6–8.71 parts of a fatty acid alkanolamine condensate such as a Kritchevsky amide, and, where foaming properties are desired, about 1–10 parts of a polyethenoxy nonionic surfactant foam agent.

A particularly useful feature of the invention is that the concentrate has little or no solvent action upon certain water-soluble film-forming polymers. Thus, packets of concentrate may be contained within water-soluble polymeric heat-sealed containers which can be conveniently dropped into the cleaner tanks of industrial scrubbers. The polymer dissolves readily in water, thereby liberating the concentrate for use. Such water soluble polymers as polyvinyl alcohol, the hydroxy alkyl acrylates and methacrylates, the cellulose ethers, etc. are suitable for this purpose.

Concentrates of the invention, when properly diluted, have remarkable cleaning power. Asphaltic detrius, greases, floor wax, metal working oils, tire and heel marks, all succumb readily at dilutions of one part of concentrate to from 300 to 1,000 parts water. Indeed, even the difficulty removable "acrylic" floor "waxes," which are really ionic bonded acrylic polymers linked through zinc atoms, can be removed. Conventional floor waxes are no problem whatsoever. Merely distributing the diluted concentrate over the surface to be cleaned, and agitating by scrubbing, brushing, or mopping, is effective to penetrate thick concentrations of embedded floor dirt and grease.

Although primarily designed and adapted for industrial and household floor cleaning services, other hard and soft surfaces are readily cleaned by immersion, spraying, brushing, etc. of the surface with the diluted concentrate. For such applications as automotive cleaning, rug cleaning, etc., where a foaming product is either required or desired, the addition of conventional polyethenoxy nonionic surfactants provide adequate foaming.

In the ensuing description of the invention, all parts, unless otherwise stated, are by weight. The adjective "lower," as applied to alkyl and equivalently similar groups, denotes such groups of from 1 to 4 carbon atoms. The term "higher," as applied to similar groups, denotes those having more than 4 and up to about 22 carbon atoms, in either straight or branched chain structures.

As indicated above, the constituent which comprises the major amount of the concentrate is about 30–60 parts by weight of an ethylene glycol mono (lower)alkyl ether solvent. The n-butyl member, is preferred, although the available methyl, ethyl, and isobutyl ethers are suitable. Some adjustment of the proportions of other ingredients may be desirable for optimum benefits when employing materials other than the butyl derivative, but these are well within the skill of routine experimentation. In any event, the ether functions as a powerful solvent for greasy material, and it is quite unusual to find a concentrate containing as much as 30–60 parts by weight, and preferably about 50 parts by weight, of such an organic material.

The second ingredient is about 17–24.5 parts by weight of an alkali hydroxide such as potassium hydroxide. The term "alkali," as employed herein, is intended to denote the monovalent metal alkalies such as potassium (preferred), sodium (somewhat less preferable, but more economical), lithium (expensive), and, where applicable, ammonium (weaker but nonetheless effective).

The third ingredient is about 9–15 parts by weight (on an anhydrous basis) of a water soluble alkali metasilicate, preferably sodium metasilicate. Both the alkali hydroxide and the alkali metasilicate function as power alkalies or builders, and in combination with the organic solvent, apparently have a synergistic effect on the removal of greasy matter. While attempts have heretofore been made to increase the concentration of these ingredients, these attempts have rarely been successful to the extent achieved herein, since these inorganic solids are only sparcely soluble in the ethylene glycol monoalkyl ether solvent. As will appear, this difficulty has been overcome.

The fourth ingredient of the concentrate is about 1.2–3.45 parts of a nonionic ampholyte which is either a (higher)alkyl betaine or an alkali salt of N-(higher)alkyl beta aminodipropionate. Suitable betaines include coco amide betaine, coco betaine, stearyl betaine, and tallow betaine, all of which are available commercially. Suitable alkali salts of the aminodipropionates include the preferred mono sodium salt of N-lauryl beta aminodipropionate, the disodium n-lauryl beta aminodipropionate, disodium N-tallow beta amino dipropionate, sodium N-coco beta amino propionate, N-coco beta amino propionic acid, and N-lauryl myristal beta amino propionic acid.

The fifth constituent is about 0.6–1 parts by weight of an anionic hydrotrope chosen from the alkali salts of benzene and (lower)alkyl benzene sulfonates. These hydrotropes include sodium, potassium, and ammonium salts of benzene, xylene, toluene, or cumene sulfonates. In combination with the nonionic amphoylate, the hydrotropes serve as effective dispersants of the inorganic alkalies into the organic solvent and, in addition, contributes surfactant and germicidal properties to the final cleaner.

An optional, though highly advantageous, constituent is about 0.6–8.71 part of a fatty acid alkanolamine condensate, preferably of the Kritchevsky amide type (one mol of acid condensed with two of amine). Other fatty acid alkanolamine condensates include capric diethanolamide, cetyl-palmitic alkanolamides, coconut diethanolamide, isopropanolamide, or monoethanolamide, lauric diethanolamide, isopropanolamide, monoethanolamide, or lauric-myristic diethanolamide, the linoleic alkanolamides, the myristic diethanolamide or monoethanolamide, the oleic diethanolamide or isopropanolamide, the stearic diethanolamide or monoethanolamide, and the tall oil alkanolamides.

When it is desired to impart foaming properties, about 1–10 parts by weight of a polyethenoxy nonionic surfactant foam agent may be included. The ethoxylated nonyl phenols are nonionics which are particularly effective in this regard, especially where containing an average of about nine mols of ethylene oxide per mol. Other similar compounds are listed in the standard Schwartz and Perry, "Surface Active Agents," and in the Schwartz-Perry-Berch, "Surface Active Agents and Detergents." When such a nonionic surfactant is to be included, it is advantageously added to the reaction mixture used in preparing the concentrate before the butyl ether is added.

An interesting facet of the concentrate is its water content. Ordinarily, some water is inevitable; aminodipropionates are normally supplied as 30% aqueous concentrates, hydrotropes as 40% aqueous concentrates, etc. Some additional water may be advantageously added to facilitate mixing and dispersion. However, in a typical concentrate preparation, where 5.8% free water is added (over and above that which is contained in the various ingredients), the final concentrate should theoretically contain about 2.6% water but, by Karl Fischer analyses (12 replications), the water content is about 17–24% by weight. No ready explanation of this anomaly can be found.

If desired, other ingredients may be added to the concentrate for either functional or aesthetic purposes. Anionics such as the alkali salts of alkyl, alkyl-aryl, and aryl sulfates are exemplary. Other non-ionics may include the ethoxylated phenols, the ethoxylated alkyl or other aryl alcohols, the ethoxylated amines, acids, etc., polyethylene glycols, etc.

The final concentrate, depending upon the specific ingredients and proportions, will range in viscosity from that of a slightly viscous material to that of a gel. Its stability, as defined by the retention of an apparently homogeneous mix, varies from less than 24 hours to as much as 1 year. Optimum formulations are set forth below. Illustrative concentrates, together with the preferred method of assembling them, are set forth in working examples below.

EXAMPLE I

This Example illustrates the preparation of a water-dispersible solvent emulsion type cleaner concentrate in the absence of a fatty acid alkanolamine condensate.

The reactant composition is as follows:

| Ingredients | Percent by Weight |
|---|---|
| Water | 5.0 |
| Partial sodium salt of N-lauryl beta-aminodipropionic acid (30% in water) | 11.5 |
| Sodium xylene sulfonate, 40% in water | 2.0 |
| Sodium metasilicate, anh. | 10.5 |
| Potassium hydroxide, solid | 21.0 |
| Ethylene glycol monobutyl ether | 50.0 |

The composition is made by mixing the water, the aminodipropionic acid salt, and the sodium xylene sulfonate together at room temperature. Then the sodium metasilicate is added, followed by vigorous stirring. (The heat of hydration of the metasilicate to the nine-hydrate causes the temperature of the mixture, which becomes milky in appearance, to increase to about 140°F.). Next, the potassium hydroxide is added slowly, with stirring; this causes a further increase in temperature (up to about 150°F.), and the mixture becomes very viscous, almost solid.

When additional potassium hydroxide is added to the desired concentration, the high viscosity of the mixture suddenly breaks, and the viscosity returns to approximately that of water. The mixture, which is still milky, is stirred vigorously until no solid particles are visible; filtration may be necessary.

The mixture is then allowed to cool about 85°F., either by standing or by the use of a cooling jacket, advantageously with the exclusion of atmospheric air. One-half of the butyl ether solvent is then added, followed by additional vigorous stirring for about 10 minutes. The mixture loses its milky appearance, and forms a slightly viscous, slightly yellow, emulsion. Then the remainder of the butyl ether solvent is added, and the composition stirred for an additional fifteen minutes.

The final concentrate is a light yellow emulsion having a viscosity slightly greater than that of water. It is highly alkaline, with a pH of 14. It remains as a stable emulsion having a single-phase shelf life, at room temperature, of about four weeks, whereupon it breaks into upper liquid and lower white solid layers.

The concentrate thus contains approximately 50% by weight of butyl ether solvent and 45% by weight of active cleaning solids, namely the potassium hydroxide and the sodium metasilicate. The high proportion of butyl ether, the high concentration of active cleaning solids, and the exceptionally high alkalinity, contribute to its effectiveness as a cleaning solution concentrate. The use of sodium metasilicate, rather than phosphates, avoids ecological objections and, in addition, serves to function somewhat as a corrosion preventive.

Just prior to use, the above cleaning concentrate is mixed with water in a ratio of about one and a fourth teaspoon per gallon of water, which should be compared with the ratios of conventional emulsion type cleaner concentrates of up to a cup or more per gallon. The diluted composition is remarkably effective in removing asphalts, greases, greasy soils, floor wax, metal working oils, tire and heel marks, and the like, either from dirty objects or from floors. Floor cleaning in industrial areas is particularly effective; the diluted concentrate is merely distributed over the floor and vigorously brushed or scrubbed to dissolve the detrius.

EXAMPLE II

This Example illustrates the preparation of a water-dispersible solvent emulsion type cleaner concentrate utilizing the components of Example I, but which includes a fatty acid alkanolamine condensate of the Kritchevsky type.

The concentrate has the following composition of ingredients:

| Ingredients | Percent by Weight |
|---|---|
| water | 5.8 |
| aminodipropionate, 30% in water | 6.3 |
| sodium xylene sulfonate, 40% in water | 2.3 |
| diethanolamine-coconut acid Kritchevsky amide | 1.2 |
| sodium metasilicate | 11.2 |
| potassium hydroxide, 90% | 23.2 |
| ethylene glycol monobutyl ether | 50.0 |

The composition is prepared by adding water, aminodipropionate, sodium xylene sulfonate, and the Kritchevsky amide to a vessel and thoroughly mixing for at least 10 minutes or until the solution is clear. Sodium silicate is then added with vigorous stirring, and the stirring continued until a white opaque emulsion is formed.

Potassium hydroxide is then added carefully and with regulated stirring. When the addition is completed, stirring is continued until the temperature generated drops to about 120°–130°F. The ethylene glycol monobutyl ether is introduced by slowly pouring while continuing the stirring.

The concentrate thus prepared is a white viscous liquid, with a shelf life of up to 180 days. Upon dilution with water in the proportion of 1:896 (one ounce in seven gallons of water), an effective cleaning solution is prepared which is capable of removing old grease from garage and workroom floors. At this concentration it is capable of stripping many "acrylic" floor waxes of the zinc interlock polymer type, i.e., the ionic bonded acrylic polymer floor "waxes." Conventional floor wax succumbs readily, as do fork lift and heel marks.

If desired to use the cleaning solution as a foam, a foaming agent such as ethoxylated (nine mols) nonyl phenol may be added to the above mixture before the ethylene glycol monobutyl ether is introduced: 1–10 parts by weight of this polyethenoxy nonionic surfactant, based on total concentrate, is sufficient for car wash and rug cleaning service.

EXAMPLE III

To further demonstrate variants of the Example II system, seven additional compositions are prepared in the manner of Example I, and employing the ingredients of Examples I and II but with the proportions set forth below:

Examples of Solvent Emulsion Cleaner Compositions

| Chemicals | 1 | 2 | 3 | 4 | 5 | 6 |
|---|---|---|---|---|---|---|
| Water | 0.00 | 2.75 | 4.96 | 5.00 | 5.75 | 5.75 |
| Amino dispropionate 30% in water | 6.05 | 5.72 | 5.45 | 5.76 | 3.13 | 6.30 |
| Sodium Xylene Sulfonate, 40% | 2.21 | 2.06 | 1.99 | 2.19 | 2.30 | 2.31 |
| Kritchevsky Amide | 8.71 | 8.24 | 7.84 | 5.27 | 4.59 | 1.22 |
| Sodium meta Silicate (anhy.) | 10.83 | 10.23 | 9.80 | 10.28 | 11.93 | 11.28 |
| Potassium Hydroxide, 90% | 22.20 | 21.00 | 19.96 | 21.50 | 22.30 | 23.14 |
| Ethylene glycol mono butyl ether | 50.00 | 50.00 | 50.00 | 50.00 | 50.00 | 50.00 |

Similar results are achieved.

Thus it is apparent that there has been provided, according to the invention, an outstandingly effective water-dispersible solvent emulsion type cleaner concentrate. In its recommended dilution of one ounce of concentrate in seven gallons of water, a cleaning solution is capable of removing thick grease from factory and garage floors while avoiding the hazards of toxicity, flammability, environmental damage, and other limitations of preexisting materials.

While the invention has been described in conjunction with specific embodiments, it is manifest that many alternatives, modifications, and variations will be apparent to those skilled in the art in light of the foregoing description. Accordingly, it is intended to embrace all such alternatives, modifications, and variations as fall within the spirit and scope of the appended claims.

I claim:

1. A water-dispersible solvent emulsion type cleaner concentrate comprising:

a. about 30–60 parts by weight of an ethylene glycol mono(lower)alkyl ether solvent, b. about 17–24.5 parts of an alkali hydroxide, c. about 9–15 parts of a member of the group ammonium and alkali metal metasilicates, d. a small amount of a nonionic ampholyte selected from the (higher)alkyl betaines and the alkali salts of N-(higher)alkyl beta aminodipropionates, said(-higher)alkyl groups having more than 4 and up to about 22 carbon atoms, and e. a small amount of an anionic hydrotrope selected from the alkali salts of benzene and (lower) alkyl benzene sulfonates, said amounts of (d) and (e)

being sufficient to maintain the inorganic ingredients in a stable suspension.

2. Concentrate of claim 1 including about 0.6–8.71 parts of a (higher)fatty acid alkanolamine condensate.

3. Concentrate of claim 1 including about 1–10 parts of a polyethenoxy nonionic nonyl phenol containing about nine mols of ethylene oxide per mol surfactant foaming agent.

4. Concentrate of claim 1 contained within a water soluble but concentrate-insoluble synthetic organic resin.

5. Concentrate of claim 1 wherein said ethylene glycol mono (lower)alkyl ether solvent is ethylene glycol monobutyl ether.

6. Concentrate of claim 1 wherein said alkali hydroxide is potassium hydroxide.

7. Concentrate of claim 1 wherein said alkali metal metasilicate is sodium metasilicate.

8. Concentrate of claim 1 wherein said nonionic ampholyte is a (higher)alkyl betaine.

9. Concentrate of claim 1 wherein said nonionic ampholyte is an alkali salt of an N-(higher)alkyl beta aminodipropionate.

10. Concentrate of claim 9 wherein said salt is the mono sodium salt of N-lauryl beta aminodipropionate.

11. Concentrate of claim 1 wherein said anionic hydrotrope is sodium xylene sulfonate.

12. Concentrate of claim 2 wherein said fatty acid alkanolamine condensate is a Kritchevsky amide.

13. Concentrate of claim 12 wherein said Kritchevsky amide is a condensate of about 1 mol of coconut fatty acids with 2 mols of diethanolamine.

* * * * *